US005467534A

United States Patent [19]

Salter et al.

[11] Patent Number: 5,467,534

[45] Date of Patent: Nov. 21, 1995

[54] PROCEDURE FOR DRYING A PAPER WEB AND A DRYING PART FOR A PAPER MACHINE

[76] Inventors: Robert L. Salter, Rte. 3, Box 587, Mena, Ark. 71953; Hans-Peter Sollinger, Germanenstr. 161, D-89522 Heidenheim, Germany

[21] Appl. No.: 150,449

[22] Filed: Nov. 10, 1993

[51] Int. Cl.[6] ..... F26B 11/02

[52] U.S. Cl. ..... 34/117; 34/121; 162/359.1

[58] Field of Search ..... 34/114–123, 443–447, 34/452, 458, 482; 162/363, 207, 359.1

[56] References Cited

U.S. PATENT DOCUMENTS

| | | | |
|---|---|---|---|
| 3,801,426 | 4/1974 | Putman et al. | 162/198 |
| 4,014,740 | 3/1977 | Koponen et al. | 34/120 |
| 5,062,923 | 11/1991 | Morgan | 34/117 |
| 5,311,672 | 5/1994 | Kotitschke et al. | 34/117 |

FOREIGN PATENT DOCUMENTS 2097736 12/1993 Canada .

*Primary Examiner*—Denise L. Gromada
*Attorney, Agent, or Firm*—Ostrolenk, Faber, Gerb & Soffen

[57] ABSTRACT

A process for drying a paper web and a drying section of a paper making machine. The drying section includes at least one drying group comprised of a plurality of drying cylinders, each at least partially wrapped by a web to be dried. The drying cylinders having peripheral surfaces heated for drying the web moving therepast. The peripheral surfaces of the drying cylinders in the drying groups are rotated at the velocity of the web along the web path. At least one of the drying cylinders in at least one drying group is driven to rotate at a speed that is different than the speed of the web moving past the at least one cylinder. The at least one cylinder may be selectively driven to rotate faster or slower than the speed of the web moving therepast, which applies more heat to the paper web. The invention is adaptable for a single tier drying section and/or for a double tier drying sections or for other drying section arrangements. The operation of a drying cylinder at a different speed than the other cylinders is useful for one or more than one drying cylinder in a drying group and where a drying section is comprised of more than one drying group, is useful for a drying cylinder in one or more of the drying groups.

16 Claims, 1 Drawing Sheet

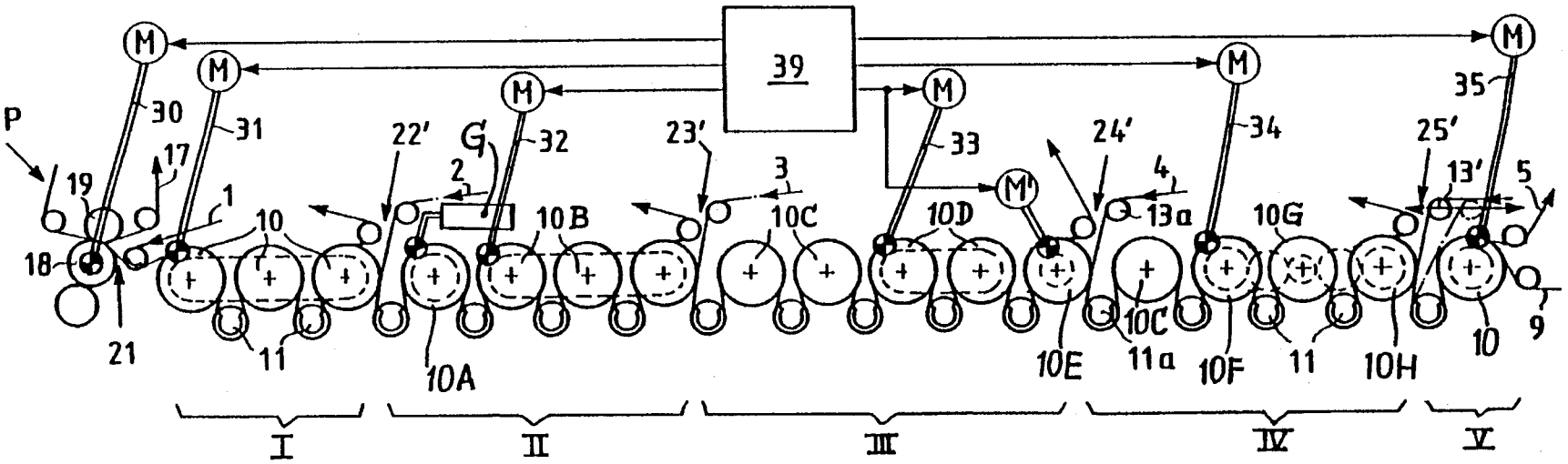
39
M
30
31
32
33
34
35
P
18
19
17
21
1
2
G
22'
23'
24'
25'
3
4
5
9
10
10A
10B
10C
10D
10E
10F
10G
10H
11
11a
13'
13a
I
II
III
IV
V

PROCEDURE FOR DRYING A PAPER WEB AND A DRYING PART FOR A PAPER MACHINE

BACKGROUND OF THE INVENTION

The present invention concerns a process for drying a paper web in a paper making machine and a machine drying section which practices the process.

A large number of publications are concerned with paper drying technology. Refer, for example, to U.S. application Ser. No. 07/931,261 filed Aug. 17, 1992 or the German equivalent, GM 92 07 656. This application involves a drying section for a paper making machine with several drying groups arranged in sequence along the web path through the drying section. Each individual drying group has a single row of drying cylinders. This single row of drying cylinders is called a single tier drying group. Between each two neighboring drying cylinders in a row there is a web transfer roll in the form of a suction guide roll for the web. A respective single endless web support belt or dryer screen or dryer fabric extends through each drying group and passes around a drying cylinder and then a suction guide roller alternately, along a meandering pathway. The paper web to be dried is carried on the one side of the support belt selected so that the web is in direct contact with the drying cylinders in the drying group while the support belt is in direct contact with the alternate suction guide rollers. As a result, the paper web is dried by being heated from only one side in a single tier drying group. In order to dry the web by heating it from its other side, another drying group follows the first mentioned group, and if the following group is a single tier drying group, the paper web is supported on the side of the respective support belt that the web makes contact with the drying cylinders on the other side of the web.

As an alternative to single tier drying groups, there are drying groups in which the paper web alternately goes around an upper row drying cylinder and then around a lower row drying cylinder, so that in moving from cylinder to cylinder along the web path within one drying group, the two sides of the paper web alternately are in direct contact with a heated drying cylinder. This type of drying group is known as a double tier group.

The present invention is suitable for both single tier and double tier drying groups in a drying section. There are several requirements for a paper web drying section. The web should pass through the drying section with great security, even at the highest working velocities. As far as possible, web breaks should be avoided for good runability. Web drying should be as intensive as possible, so that a certain amount of water contained in the paper web should be driven out over the shortest possible distance along the web path, which enables the length of the drying section when constructed to be kept as small as possible. This provides high energy density. In addition to these properties, there are other requirements for the drying section and the drying process. In many types of paper, gentle drying is very important in order to influence certain paper properties. A primary objective is to avoid wrinkling.

The present invention directs special attention to providing the highest possible energy density and thereby to provide rapid and intensive drying. One known means of removing large amounts of moisture from a paper web over a short web path consists of increasing the temperature of the peripheral coverings of the individual drying cylinders.

There are limits on this, however, involving for example the strength of the material of the drying cylinder. In addition to the energy density requirement, attention should also be paid to the requirement for gentle drying.

SUMMARY OF THE INVENTION

The invention concerns providing a paper web drying process and a drying section such that the energy density and thereby the intensity of the drying can be increased significantly, without suffering disadvantages. At the same time, the process should dry webs of delicate papers in an especially gentle way.

The invention concerns a process for drying a paper web and a drying section of a paper making machine. The drying section includes at least one drying group comprised of a plurality of drying cylinders, each at least partially wrapped by a web to be dried. The drying cylinders have peripheral surfaces heated for drying the web moving therepast. The peripheral surfaces of nearly all of the drying cylinders in the drying groups are rotated at the velocity of the web along the web path. At least one drying cylinder in at least one drying group is driven to rotate at a speed that is different than the speed of the web moving past the at least one cylinder. The at least one cylinder may be selectively driven to rotate faster or slower than the speed of the web moving therepast, which in either case applies more heat to the paper web. The invention is adaptable for a single tier drying section and/or for a double tier drying sections or for other drying section arrangements. The operation of a drying cylinder at a different speed than the other cylinders is useful for one or more than one drying cylinder in a drying group and where a drying section is comprised of more than one drying group, is useful for a drying cylinder in one or more of the drying groups.

The inventors have found that higher energy density can be provided when the circumferential velocity of at least one or perhaps of more than one of the drying cylinders in at least one drying group of a drying section is set at a different velocity than that of the web moving past, or of the web support belt of the drying group moving past and/or of the other drying cylinders in the drying group.

In a preferred embodiment, the circumferential velocity of the peripheral surface or the covering surface of at least one of the drying cylinders is set higher that the speed of the paper web moving around that cylinder or those cylinders. This means that the peripheral surface of the drying cylinder involved moves faster that the paper web, producing sliding or slipping of the paper web with respect to the surface or the covering of the drying cylinder. The inventors have recognized that this is possible without involving complications, especially without causing breakage of the paper web.

The inventors have further recognized that in gentle web drying according to another embodiment of the invention, the circumferential velocity of at least one or more of the drying cylinders can be less than the speed of the paper web passing over the periphery. This means that the peripheral surface or covering surface of the drying cylinder involved turns slower than the speed of the paper web moving past, so that a certain sliding or slipping of the paper web with respect to the covering surface of the drying cylinder again occurs.

The use of the different speeds between the covering surface of the drying cylinder on the one hand and the paper web on the other hand causes the amount of heat available to the paper web at the cylinder covering surface during passage of the web over the cylinder surface to be greater than when the peripheral speed of the cylinder and the web speed are identical. The amount of heat increases because the web is exposed to the heat from more than just one circumferential part of the covering surface of the cylinder wrapped by the web. This applies whether the cylinder surface is moving slower or faster than the web. The heat increase does not rely upon or derive from friction between the web and the cylinder.

Other measures may be appropriate in order to make good use of the invention. Thus, the covering surface of the drying cylinder involved may be provided with a coating that reduces the coefficient of friction with respect to the paper web, or with respect to the support belt or dryer screen if the paper web is absent. The difference in speeds may be started only after the drying section has been in operation for a certain period of time, e.g. several minutes. In order to make the transition from operation with the web and drying cylinders at identical speeds to their operating at different speeds easier, for example, a spraying device for applying a lubricant can be provided to spray lubricant at the places where the paper web or the support belt contacts the covering surface of the drying cylinder. This spraying device would emit a spray for a very short time sufficient to reduce the static friction between the running web and the covering surface of the drying cylinder concerned so that slipping in achieved. Once a slipping state is initiated, it can be maintained without having spray subsequently applied. Here the spray can be applied either to the paper web, to the covering surface of the drying cylinder, or to the wedge shaped space between them.

BRIEF DESCRIPTION OF THE DRAWING

Other features and advantages of the present invention are described below with reference to the accompanying drawing, which is a schematic side view of a drying section of a paper making machine.

DESCRIPTION OF THE PREFERRED EMBODIMENT

The drawing shows a drying section, with a web path through the drying section from left to right. Before the entrance to the drying section at the left, there is a paper machine press P, which includes two press rolls 18 and 19 that form a press nip between them. The paper web 9 being produced runs through this press nip together with a dewatering felt 17. The press P is the last press of a paper machine press section, the upper portion of which is not shown in the diagram. The press P has a drive 30, which is shown only schematically. There is a separation place or transfer zone between the press P and dryer section I at 21.

Following the press section, the drying section is comprised of five drying groups I through V. Each drying group has its own endless loop, web support belt or dryer screen or fabric 1 through 5, respectively, a respective series of drying cylinders 10 and a respective series of web transfer rolls in the form of suction guide rolls 11, which alternate with the drying cylinders. The suction guide rolls are placed off the line of the drying cylinders to cause the support belt 1–5 and the supported web to wrap a significant circumferential distance, over a large arcuate part of the drying cylinder surface. Also, there are ordinary additional belt guide rolls 13 for guiding, tightening, and regulating the respective endless support belt loops. A separation place or transfer zone 22'–25' is present between each drying group. A guide roll (e.g. **13*a*) and suction roll (e.g. 11*a*) are provided at the transfer points. Additionally, as shown by 13'**, a guide roll can be movable thereby to allow open or closed draw at the transfer zone.

A horizontal row or series of drying cylinders, one for each drying group have been shown. However, vertical, inclined or V-shaped cylinder arrangements are also envisioned. All of the drying groups are single tier and top felted, and in all of the groups, only the bottom side of the web directly contacts the drying cylinders. An alternating single tier arrangement, as in U.S. Pat. No. 5,184,408, could use the invention. Also, a double tier arrangement may use the invention.

Each of the drying groups I–V has its own drive 31–35 (controlled by controller 39) which directly rotates one or more of the respective cylinders and/or rolls, or even the support belt, and through the support belt indirectly drives the remaining cylinders and rolls in the group. All of the cylinders in each group rotate in the same respective direction of web travel through the drying section.

According to one embodiment of the invention, in at least one of the drying groups I–V, at least one of the cylinders is driven to rotate at a rate such that the circumferential velocity of the peripheral or covering surface of the designated cylinder ("fast cylinder") is greater than the velocity of the paper web 9 passing over the cylinder surface. The other cylinders have, in contrast, the same circumferential velocity as the support belt of the group. Because of the difference in speed between the covering surface of the fast cylinder and the paper web, the paper web slides or slips. Since each point on the surface of the paper web comes into contact with several surface elements of the covering surface of the fast cylinder while they are in motion, more heat is delivered to the paper web, so that more intensive drying of the paper web takes place than would otherwise occur if the same cylinder were rotating at the speed of the web moving past it.

In the drying section as shown, the following configuration can be envisioned:

In drying group I, three drying cylinders 10 are driven conventionally, i.e., they have the same circumferential velocity as the paper web 9.

In drying group II, the first drying cylinder 10A is driven by a separate drive G from a drive shaft 32 so that its peripheral surface moves at a higher speed than the web moving past. The other cylinders 10B, in Group II, in contrast, are driven at the same circumferential velocity as the paper web 9 moving past, in the conventional manner.

In drying group III, the two first drying cylinders 10C have no drive of their own, but are rotated by the paper web support belt 3 of that group moving over them. The third and fourth cylinders 10D are driven conventionally, i.e with the same circumferential velocity as the paper web. The last cylinder 10E in group III, in contrast, has its own motor M', which drives the cylinder so that its peripheral surface moves at a higher speed than the web moving past it.

In drying group IV, the first cylinder 10C has no drive of its own and is moved by the support belt. The second cylinder 10F is driven conventionally, i.e. at normal circumferential velocity. The third cylinder 10G is driven at a higher speed than the paper web. The fourth drying cylinder 10H operates at normal speed. Cylinders 10F, 10G, and 10H are coupled together by means of gears. Cylinder 10G has a lower speed drive gear than cylinders 10F and 10H and the gear ratio determines the cylinder velocity.

In drying group V, the single cylinder 10 is driven conventionally, i.e. with the same circumferential velocity as the paper web 9.

The invention permits numerous variants. Thus, it may be appropriate to place the fast cylinder at the start of the drying section, in the middle, or at the end of the drying section. For example, only drying group III could be equipped with one or more fast cylinders while the other drying groups are provided only with normal speed cylinders. It may also be appropriate to have individual fast cylinders either at the beginning, in the middle, or at the end of a particular drying group.

In yet another embodiment of the invention, which is illustrated by the same drawing, the individually driven cylinders in one or each of the drying groups may be driven more slowly than the remaining drying cylinders. For example, the same cylinders in the drawing which were described above as having a higher velocity in this embodiment instead have a lower velocity than the other cylinders.

According to the invention, there is a definite difference between the circumferential velocity of at least one or more of the drying cylinders in the drying section and the paper web passing through the section. This difference only needs to be small, a few percent points, but it can also be 5%, 7%, 10% and, in extreme cases, can be as much as 20% or 30%.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed:

1. A process for drying a paper web comprising passing the paper web over the dryers of a drying group which comprises a plurality of drying cylinders each with a heated peripheral drying surface, and rotating all of the cylinders in the direction of movement of the web along the web path through the drying section;

driving fewer than all of the cylinders to rotate so that their peripheral surfaces engaged by the paper web travel at substantially the same circumferential velocity as the web moving therepast;

driving at least one of the drying cylinders in the drying group so that the circumferential velocity of the peripheral surface of the at least one drying cylinder differs from the velocity of the paper web passing by the peripheral surface of that at least one drying cylinder.

2. The process of claim 1, further comprising moving a support belt over at least some of the drying cylinders of the drying group at the velocity of the web, and supporting the web on that surface of the belt such that the web is in contact with the peripheral surfaces of the drying cylinders.

3. The process of claim 2, further comprising supporting the web supporting belt to move through the drying group so that the web partly wraps around the peripheral surface of each of the drying cylinders in the drying group.

4. The process of claim 3, wherein the circumferential velocity of the peripheral surface of the at least one drying cylinder is different by being higher than the velocity of the paper web moving past the cylinder.

5. The process of claim 3, wherein the circumferential velocity of the peripheral surface of the at least one drying cylinder is different by being lower than the velocity of the paper web moving past the cylinder.

6. The process of claim 3, further comprising adjusting the velocity difference between the peripheral surface of the drying cylinder operating at a different velocity than the velocity of the web moving therepast and the velocity of the web moving therepast.

7. The process of claim 3, further comprising guiding the supporting belt in a meander path alternately over a drying cylinder and then over a transfer roll between two of the drying cylinders for causing the belt to partially wrap the cylinders.

8. A drying section of a paper making machine comprising:

at least one drying group comprising a first plurality of heated, web drying cylinders arranged to define a path of the web through the drying group, wherein the cylinders are so arranged that the web at least partially wraps around the peripheral surface of each of the drying cylinders as the web moves through the drying group, and the drying cylinders being rotatable so that the peripheral surfaces rotate in a direction of the web moving past the drying cylinders in the web path;

a support belt which partially wraps at least some of the drying cylinders in the drying group to enclose the paper web between the belt and the wrapped cylinders;

means for driving the peripheral surfaces of the drying cylinders to rotate as the web moves therepast; the driving means for at least one of the cylinders driving the one drying cylinder so that the circumferential velocity of its peripheral surface differs from the speed of the paper web then moving past the one drying cylinder.

9. The drying section of claim 8, wherein the driving means for the at least one drying cylinder drives its peripheral surface to rotate at a circumferential velocity that is higher than the speed of the web moving therepast.

10. The drying section of claim 8, wherein the driving means for the at least one drying cylinder drives its peripheral surface to rotate at a circumferential velocity that is lower than the speed of the web moving therepast.

11. The drying section of claim 8, further comprising means at the at least one drying cylinder for overcoming the static friction between the paper web and the peripheral surface of the at least one cylinder for permitting the peripheral surface of the at least one cylinder to operate at a different speed than the paper web.

12. The drying section of claim 8, wherein the driving means for the at least one drying cylinder drives its peripheral surface to rotate at a circumferential velocity different from the speed of the support belt then moving past the at least one drying cylinder.

13. The drying section of claim 9, further comprising means at the at least one drying cylinder for overcoming the static friction between the support belt and the peripheral surface of the at least one cylinder for permitting the at least one cylinder to operate at a different speed than the support belt.

14. The drying section of claim 8, comprising a plurality of the dryer groups; at least one of the dryer groups having the at least one drying cylinder therein and the respective driving means for the at least one cylinder.

15. The drying section of claim 14, wherein more than one of the drying groups has a respective at least one drying cylinder and a respective driving means for the at least one drying cylinder in the respective group.

16. The drying section of claim 14, wherein at least some of the dryer groups are single tier drying groups comprising a respective transfer roll disposed between each two adjacent drying cylinders in the web path through the single tier drying group, and the support belt so supporting a web thereon that the web is sandwiched between the belt and the drying cylinder as the web passes over each drying cylinder, while the web passes around the outside of the belt as the belt passes in contact with each transfer roll between the drying cylinders in the single tier drying group.

* * * * *